US009016602B2

(12) United States Patent
Grether

(10) Patent No.: US 9,016,602 B2
(45) Date of Patent: Apr. 28, 2015

(54) JET REGULATOR

(75) Inventor: Hermann Grether, Mullheim (DE)

(73) Assignee: Neoperl GmbH, Müllheim (DE)

( * ) Notice: Subject to any disclaimer, the term of this patent is extended or adjusted under 35 U.S.C. 154(b) by 334 days.

(21) Appl. No.: 13/636,821

(22) PCT Filed: Dec. 8, 2010

(86) PCT No.: PCT/EP2010/007452
§ 371 (c)(1),
(2), (4) Date: Sep. 24, 2012

(87) PCT Pub. No.: WO2011/116800
PCT Pub. Date: Sep. 29, 2011

(65) Prior Publication Data

US 2013/0008980 A1 Jan. 10, 2013

(30) Foreign Application Priority Data

Mar. 23, 2010 (DE) ..... 10 2010 012 326

(51) Int. Cl.

| | |
|---|---|
| ***E03C 1/08*** | (2006.01) |
| ***B05B 7/06*** | (2006.01) |
| ***B05B 1/34*** | (2006.01) |
| ***B05B 1/26*** | (2006.01) |
| ***E03C 1/084*** | (2006.01) |

(52) U.S. Cl.
CPC . *E03C 1/08* (2013.01); *E03C 1/084* (2013.01); *E03C 2201/70* (2013.01)

(58) Field of Classification Search
USPC ..... 239/428.5, 432, 461, 463, 466, 467, 239/494, 495, 496, 500, 504; 137/801
See application file for complete search history.

(56) References Cited

U.S. PATENT DOCUMENTS

| | | | | |
|---|---|---|---|---|
| 2,633,343 | A * | 3/1953 | Aghnides | 239/428.5 |
| 2,754,097 | A * | 7/1956 | Hjulian | 239/428.5 |
| 2,797,906 | A * | 7/1957 | Aghnides | 261/76 |
| 2,998,929 | A * | 9/1961 | Aghnides | 239/428.5 |
| 2,998,933 | A * | 9/1961 | Aghnides | 239/428.5 |

(Continued)

FOREIGN PATENT DOCUMENTS

| | | |
|---|---|---|
| DE | 4436193 | 4/1996 |
| DE | 19852411 | 5/2000 |

(Continued)

*Primary Examiner* — Justin Jonaitis
(74) *Attorney, Agent, or Firm* — Volpe and Koenig, P.C.

(57) ABSTRACT

A jet regulator (1), including an annular or sheath-shaped jet regulator housing (2), the outlet end face (3) of which is designed as a hole structure, grate structure, and/or mesh structure having passage openings (6) surrounded by flow-guiding walls, wherein the hole structure, grate structure, and/or mesh structure on the outlet end face is made of a manually deformable, dimensionally elastic plastic material (7) at least in some sections and at least at the surface. The jet regulator (1) according to the invention is characterized in that the outlet end face (3) of the jet regulator housing (2) is designed as an outlet disk (8) that can be inserted into the jet regulator housing (2) and that supports the hole structure, grate structure, and/or mesh structure. The separate design of the outlet disk (8) and of the jet regulator housing (2) makes it easier to separately produce said jet regulator components (2, 8) even from materials that cannot be welded or otherwise connected to each other, optionally in different production methods.

8 Claims, 12 Drawing Sheets

(56) References Cited

U.S. PATENT DOCUMENTS

| | | | | |
|---|---|---|---|---|
| 3,138,332 | A * | 6/1964 | Hinderer | 239/427 |
| 3,684,191 | A * | 8/1972 | Shames et al. | 239/428.5 |
| 5,114,072 | A * | 5/1992 | Barhydt, Sr. | 239/428.5 |
| 2005/0247805 | A1* | 11/2005 | Grether | 239/428.5 |
| 2006/0011748 | A1* | 1/2006 | Ferrari | 239/428.5 |

FOREIGN PATENT DOCUMENTS

| | | |
|---|---|---|
| DE | 202005021363 | 11/2007 |
| EP | 0597344 | 10/1993 |
| EP | 1918465 | 5/2008 |
| WO | 9506787 | 3/1995 |
| WO | 2004033807 | 4/2004 |

* cited by examiner

JET REGULATOR

BACKGROUND

The invention relates to a jet regulator having a ring-shaped or sleeve-shaped jet regulator housing, the outlet face side of which is formed as an outlet disk which can be inserted into the jet regulator housing and which bears a perforated, grate and/or mesh structure with throughflow openings bordered by flow-guide walls, wherein the perforated, grate and/or mesh structure on the outlet face side is produced at least in regions and at least on the surface from a manually deformable dimensionally elastic plastic material, wherein the outlet disk can be inserted into the jet regulator housing from the inlet-face-side ring or sleeve opening of the jet regulator housing as far as at least one insertion stop, wherein a jet splitter which divides the inflowing water stream into a number of individual jets is positioned upstream of the outlet disk as viewed in the flow direction, and wherein at least one insert part which can be inserted into the jet regulator housing and which has a perforated, grate and/or mesh structure with throughflow openings bordered by flow-guiding walls is positioned upstream of the outlet disk, and/or downstream of the jet splitter, as viewed in the flow direction.

Already known from DE 198 52 411 A1 is a jet regulator which can be mounted on a sanitary outlet fitting. The already-known jet regulator has a jet regulator housing which is in the form of a sleeve-shaped molded body on which a soft or dimensionally elastic plastic material is injection-molded at the outlet side. That constituent of the jet regulator housing which is composed of soft or dimensionally elastic plastic material forms a soft and/or water-repellent surface, the aim of which is to substantially prevent limescale formation. It is the intention for adherent limescale deposits to be easily detachable by slight manual deformation of the soft or dimensionally elastic plastic material which is injection-molded on the surface. Since it must be ensured with regard to the material selection that the soft or dimensionally elastic plastic material can be injection-molded onto the relatively hard or dimensionally rigid plastic material of the jet regulator housing, the production of the already-known jet regulator can require a not inconsiderable amount of additional outlay.

Already known from DE 20 2005 021 363 U1 is a jet regulator whose sleeve-shaped jet regulator housing is formed from two housing parts which can be detachably connected to one another in a plane oriented transversely with respect to the housing longitudinal axis. The already known jet regulator has, on its outlet face side, an outlet disk which is held pivotably in the jet regulator housing for the purpose of directing the emerging water jet. For this purpose, the outlet disk, which may have a perforated structure with honeycomb-like throughflow holes, has a spherical-cap-shaped outer circumference which is pivotably guided in a wall portion, formed as a spherical joint socket, of the outflow-side housing part. It is also possible here for the outlet disk to have a limescale-detaching or limescale-repellent coating composed of elastic material.

Already known from WO 95/06787 is a jet aerator of the type mentioned in the introduction whose ring-shaped or sleeve-shaped housing has an outlet face side which is formed as an outlet disk which can be inserted into the jet regulator housing and which bears a grate structure with throughflow openings bordered by flow-guiding walls. The outlet disk can be inserted into the jet regulator housing from the inlet-side ring or sleeve opening of the jet regulator housing as far as at least one insertion stop. A jet splitter is positioned upstream of the outlet disk as viewed in the flow direction, which jet splitter has the task of dividing the inflowing water stream into a number of individual jets. Two insert parts which likewise have a grate structure can be inserted into the jet regulator housing, which insert parts are positioned upstream of the outlet disk, and downstream of the jet splitter, as viewed in the flow direction.

Already known from EP 0 597 344 A1 is a shower head having a housing which can be connected to the water supply. The housing is equipped, at the outflow side, with a base part on which resiliently elastic, hose-like water jet nozzles are provided. The base part is produced from a plastic composite material, in such a way that the water jet nozzles formed from resiliently elastic plastic material are injection-molded onto a carrier plate, which is composed of plastic, in the region of the passage openings.

Said already known outlet parts are however associated with a relatively large amount of outlay in terms of design and production.

SUMMARY

It is therefore the object to create a jet regulator of the type mentioned in the introduction which can be produced from a wide variety of materials with relatively little outlay.

Said object is achieved according to the invention, in the case of the jet regulator of the type mentioned in the introduction, in particular in that the outlet disk is formed as a multi-component injection-molded part which has a main or molded body composed of hard or dimensionally rigid plastic material and onto which is injection-molded a constituent composed of relatively soft or dimensionally elastic plastic material, and in that the outlet disk bears the constituent composed of relatively soft or dimensionally elastic plastic material even in its partial region which bears against the jet regulator housing, in such a way that the soft or dimensionally elastic plastic material provides sealing in the ring-shaped zone between the outlet disk and the housing inner circumference of the jet regulator housing.

The jet regulator according to the invention is in the form of an aerated jet regulator. The outlet face side of its jet regulator housing is in the form of an outlet disk which can be inserted into the jet regulator housing and which bears the perforated, grate and/or mesh structure. According to the invention, said outlet disk is formed as a multi-component injection-molded part which has a main or molded body composed of hard or dimensionally rigid plastic material and onto which is injection-molded a constituent composed of relatively soft or dimensionally elastic plastic material. Such an outlet disk which is formed as a multi-component injection-molded part is characterized, despite the dimensionally elastic plastic material provided at least on the surface, by high dimensional rigidity, even if said outlet disk is supposed to have complex structures. Here, the outlet disk of the jet regulator according to the invention bears the constituent composed of relatively soft or dimensionally elastic plastic material even in its partial region which bears against the jet regulator housing, in such a way that the soft or dimensionally elastic plastic material provided in said region, too, provides sealing in the ring-shaped zone between the outlet disk and housing inner circumference of the jet regulator housing. This is advantageous for example in the case of jet regulators in which an outlet disk pivotably mounted in the jet regulator housing does not permit an infinitely high contact pressure of the outlet disk in the jet regulator housing, but rather must be mounted there in a pivotable but nevertheless sealed manner. A jet splitter which divides the inflowing water stream into a number of individual jets is positioned upstream of said outlet disk as viewed in the flow direction. Since a jet splitter of said type leads to an acceleration of the individual jets generated therein, there arises on the outflow side of said jet splitter a negative pressure by means of which ambient air can be sucked into the jet regulator housing, which ambient air is subsequently mixed there with the throughflowing water to form a sparkling, soft water jet, and split up. To slow the speed of the individual jets generated in the jet splitter and/or to form the water jet into a homogeneous and non-sputtering water jet in the interior of the jet regulator housing, at least one insert part which can be inserted into the jet regulator housing and which has a perforated, grate and/or mesh structure with throughflow openings bordered by flow-guiding walls is positioned upstream of the outlet disk, and/or downstream of the jet splitter, as viewed in the flow direction. The separate configuration of the outlet disk on the one hand and the jet regulator housing on the other hand facilitates the separate production of said jet regulator constituents even from materials which cannot be welded or otherwise connected to one another, if appropriate also in different production processes. The materials required for the outlet disk on the one hand and for the jet regulator housing on the other hand can be freely selected independently of one another in accordance with the relevant permissions, demands and the like. For the production of the jet regulator housing, therefore, it is possible for example to use an ultrasound-weldable material, which by contrast may not be preferable for the outlet disk.

In order that the structures provided on the outlet disk, on the at least one insert part and/or on the jet splitter can be adapted to one another, it is advantageous for the outlet disk, the at least one insert part and/or the jet splitter to be held in a rotationally secured manner in the jet regulator housing.

To ensure a rotationally secured relative position of those constituents of the jet regulator according to the invention which are inserted into the jet regulator housing, it is advantageous if, on the inner circumference of the jet regulator housing, there is provided at least one guide groove and/or at least one guide projection which interacts with a complementary guide projection and/or with a complementary guide groove on the outlet disk, on the at least one insert part and/or on the jet splitter.

In order that any dirt particles possibly entrained in the inflowing water stream cannot block the structures provided in the jet regulator housing and impair the function of the jet regulator according to the invention, it is advantageous for an upstream or filter screen to be detachably latched, or similarly detachably held, on the jet regulator housing at the inlet side.

One preferred embodiment of the invention provides that at least one component of the following components: outlet disk, insert part, jet splitter or upstream screen, is supported by means of at least one in particular central pin on a component which is arranged at the inflow side and/or at the outflow side.

By means of the jet regulator which is provided on the water outlet of a sanitary outlet fitting, it is possible for the water jet emerging from said water outlet to be diverted, and also re-directed relative to the washbasin, if the outlet disk is held pivotably in the jet regulator housing for the purpose of diverting or directing the emerging water jet.

For this purpose, one preferred refinement of the invention provides that the outlet disk has, at least in regions, an outer circumference which is in the shape of a spherical segment or spherical disk and which is pivotably held in a partial region, in the form of a joint socket, of the jet regulator housing.

BRIEF DESCRIPTION OF THE DRAWINGS

Refinements of the invention will emerge from the following description in conjunction with the drawings. The invention will be explained in more detail below on the basis of preferred exemplary embodiments.

In the drawings.

DETAILED DESCRIPTION OF THE PREFERRED EMBODIMENTS

Figure 2:
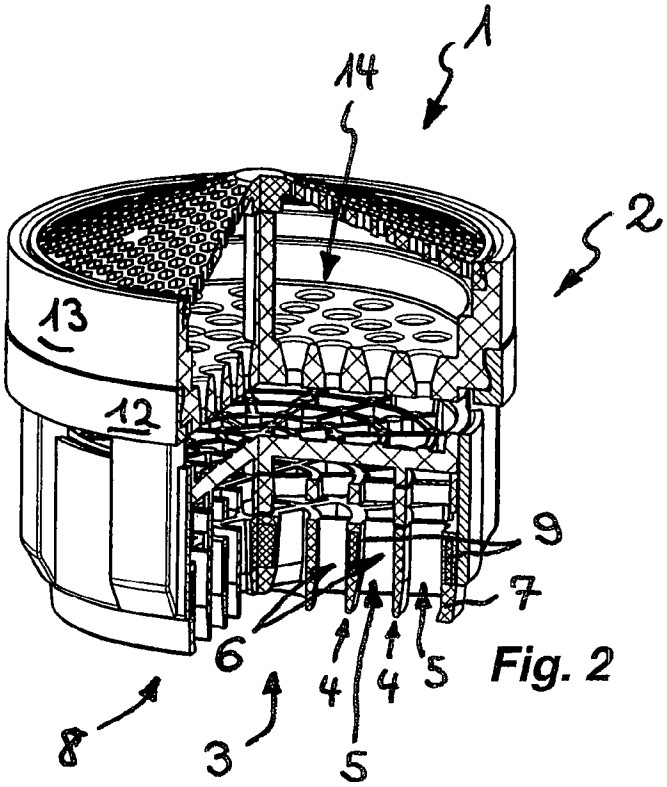
FIG. 2 shows the jet regulator from FIG. 1 in a partially cut-away perspective illustration.
Figure 1:
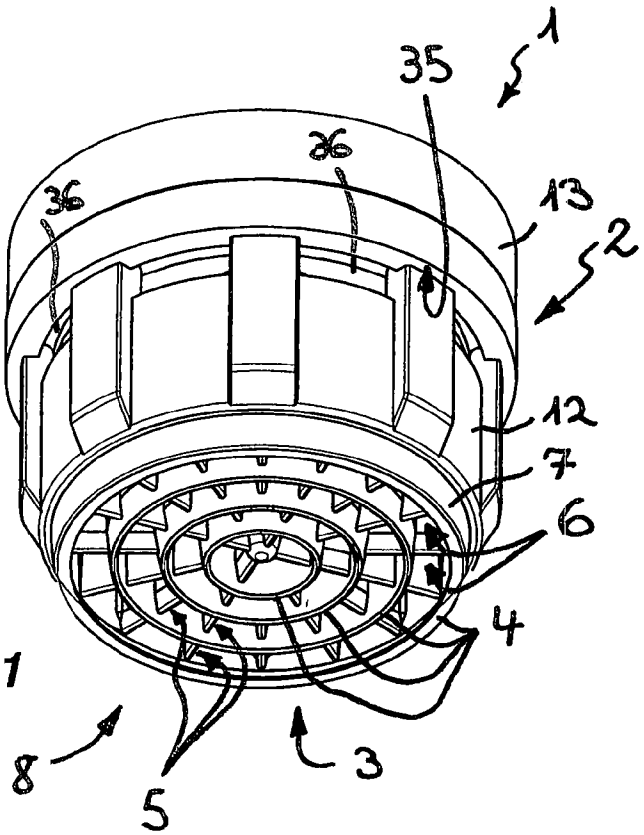
FIG. 1 shows, in a perspective illustration, a jet regulator which, on the outlet face side of its jet regulator housing, has an outlet disk which can be inserted into the jet regulator housing and which is produced at least in regions and at least on the surface from a manually deformable, dimensionally elastic plastic material.
Figure 3:
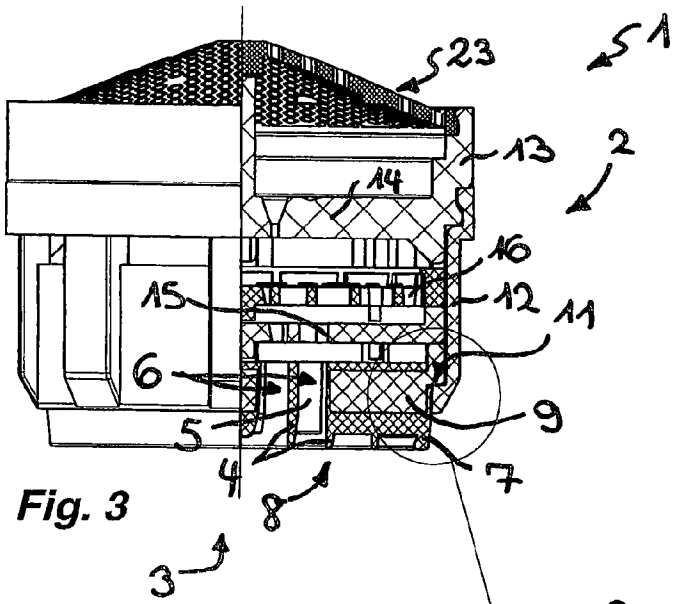
FIG. 3 shows the jet regulator from FIGS. 1 and 2 in a partial longitudinal section.
Figure 4:
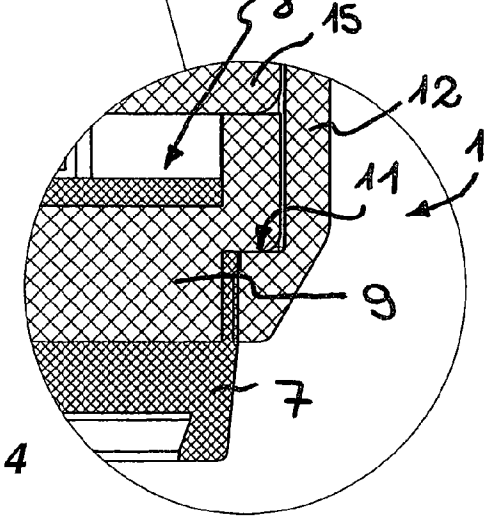
FIG. 4 shows the jet regulator from FIGS. 1 to 3 in a detail illustration in the region of its outlet disk inserted into the jet regulator housing.
Figure 5:
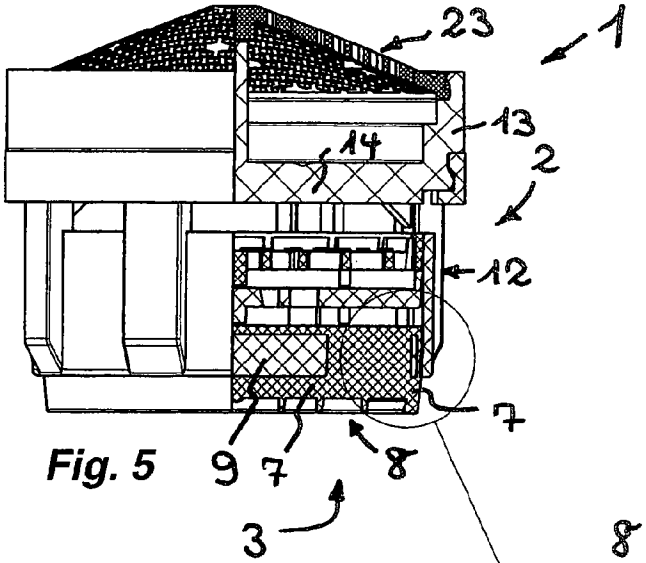
FIG. 5 shows the jet regulator from FIGS. 1 to 4 in a partial longitudinal section rotated in the circumferential direction relative to FIG. 3.
Figure 6:
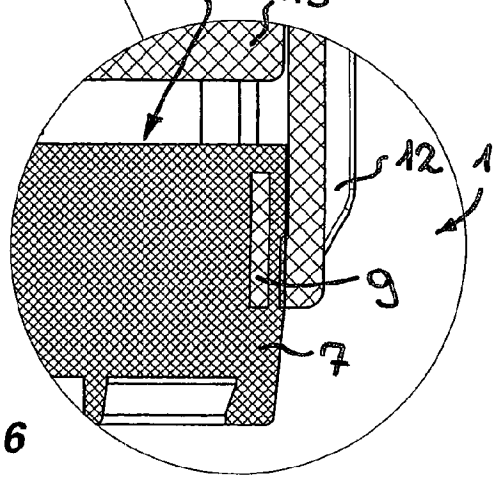
FIG. 6 shows the jet regulator from FIGS. 1 to 5 in a longitudinally sectioned detail illustration in the region of the outlet disk inserted into the jet regulator housing.
Figure 7:
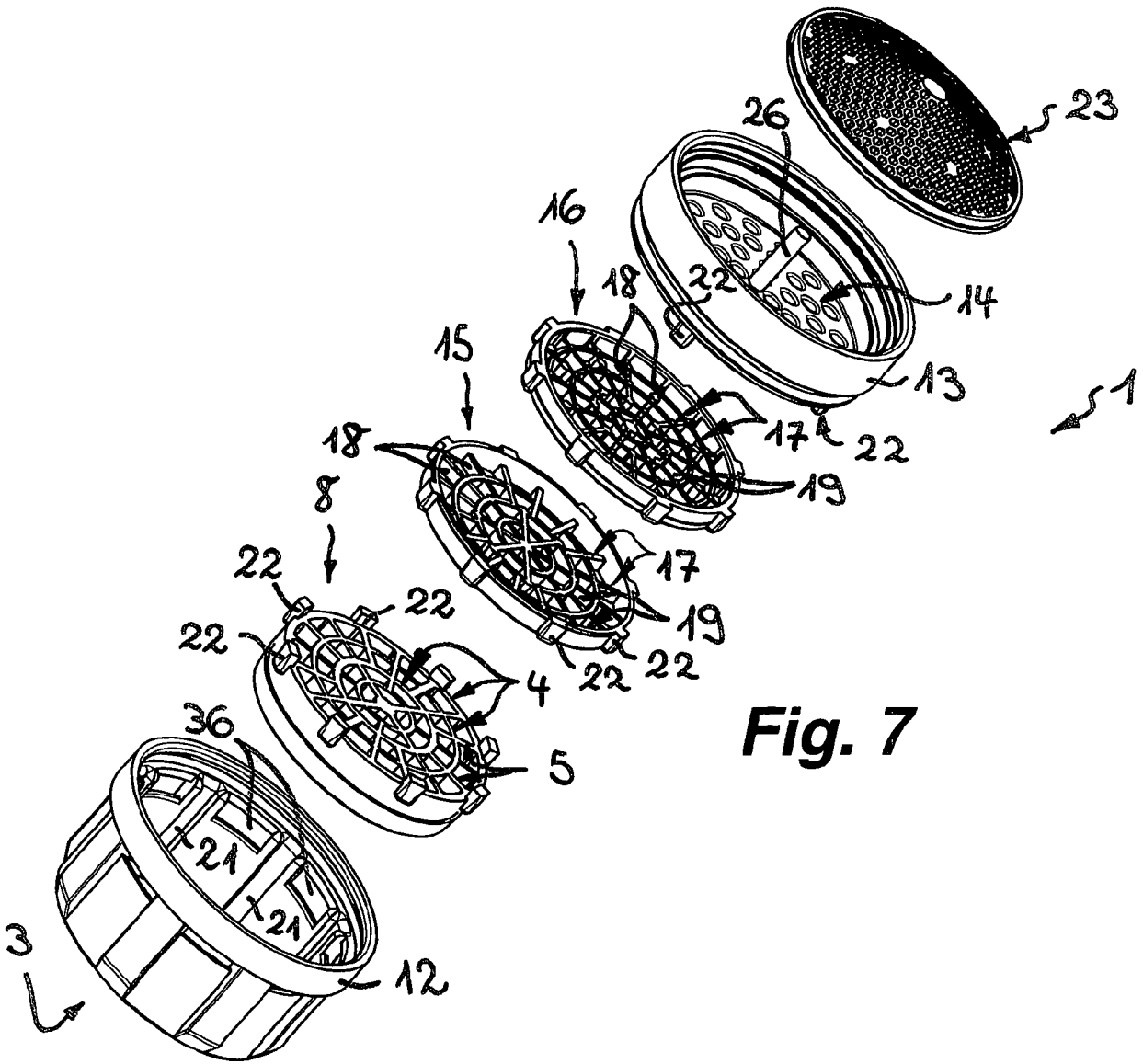
FIG. 7 shows the jet regulator from FIGS. 1 to 6 in an exploded perspective illustration, wherein said illustration shows a view of the inflow side of the individual constituents of the jet regulator.
Figure 8:
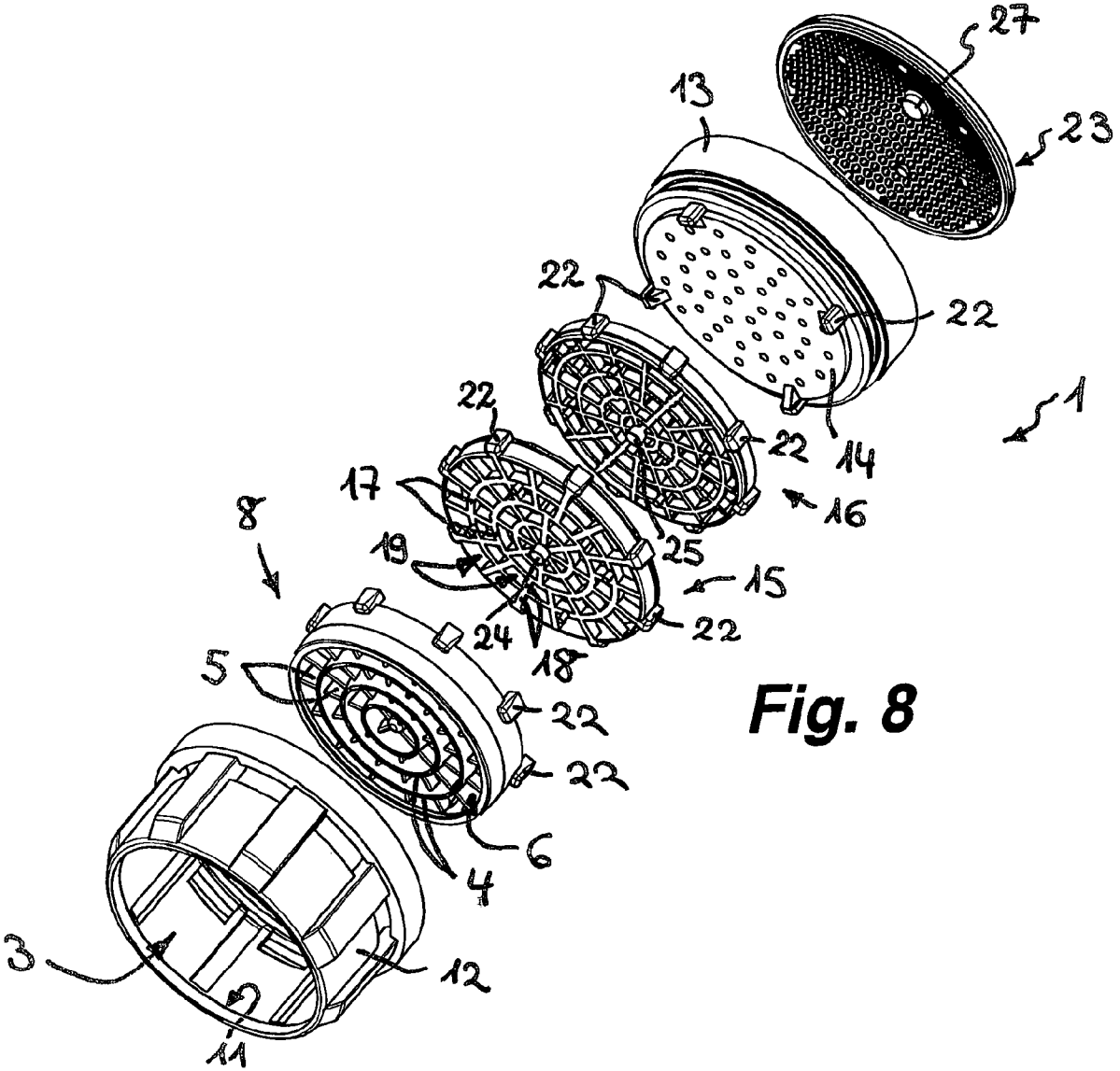
FIG. 8 shows the jet regulator from FIGS. 1 to 7 in an exploded perspective illustration, wherein the illustration shows a view of the outflow side of the constituents of the jet regulator.
Figure 10:
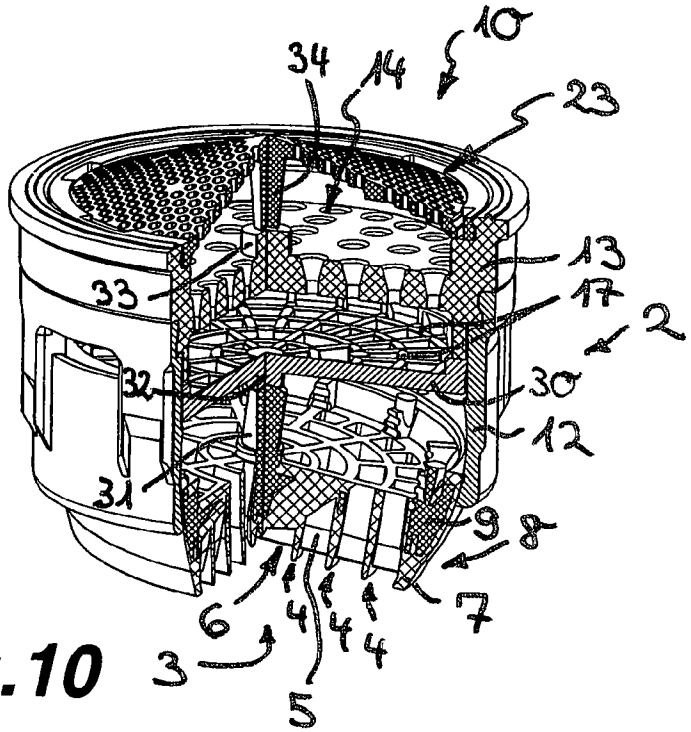
FIG. 10 shows the jet regulator from FIG. 9 in a partially sectional perspective illustration.
Figure 9:
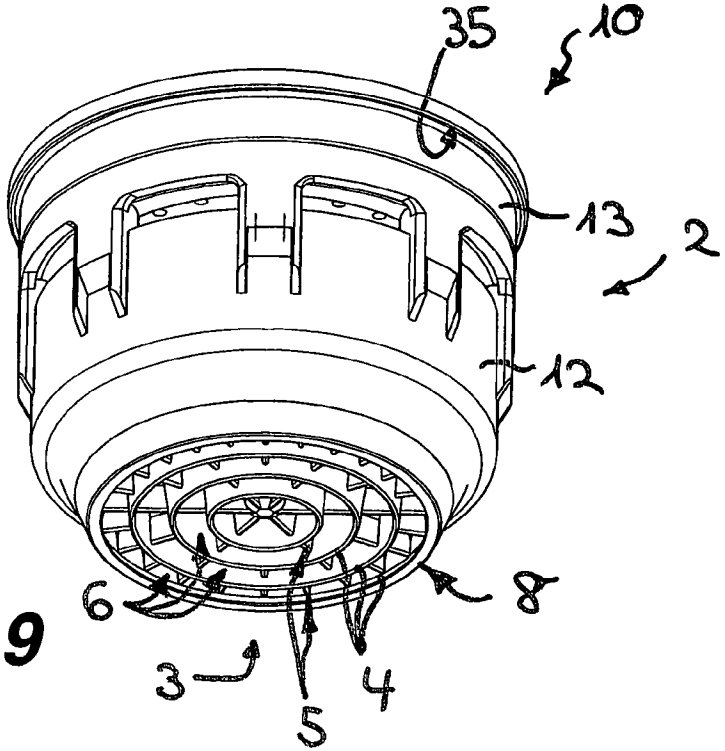
FIG. 9 shows, in a perspective illustration, a jet regulator which substantially corresponds in terms of design to the jet regulator from FIGS. 1 to 8, wherein in this case, however, the outlet disk is mounted pivotably in the jet regulator housing.
Figure 12:
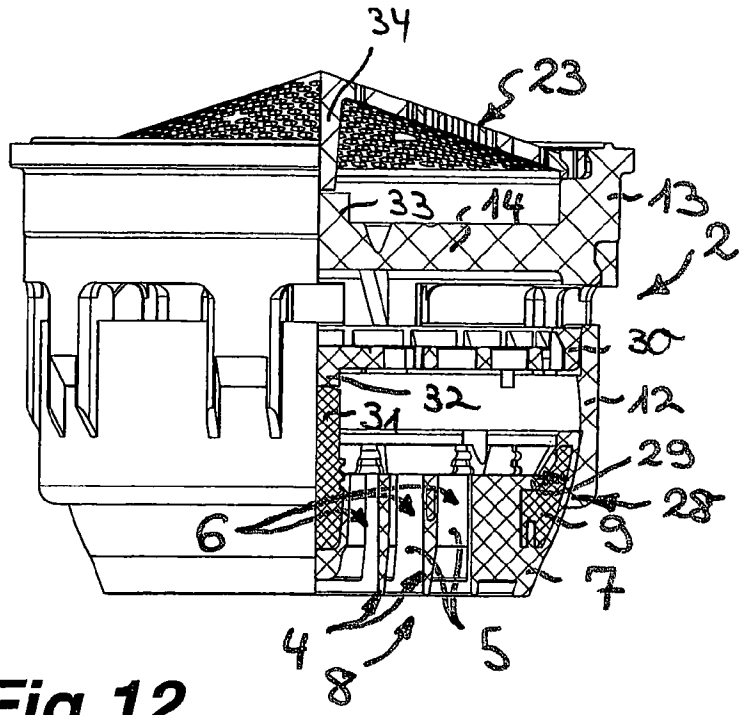
FIG. 12 shows the jet regulator from FIGS. 9 to 11 in a partial longitudinal section rotated in the circumferential direction.
Figure 11:
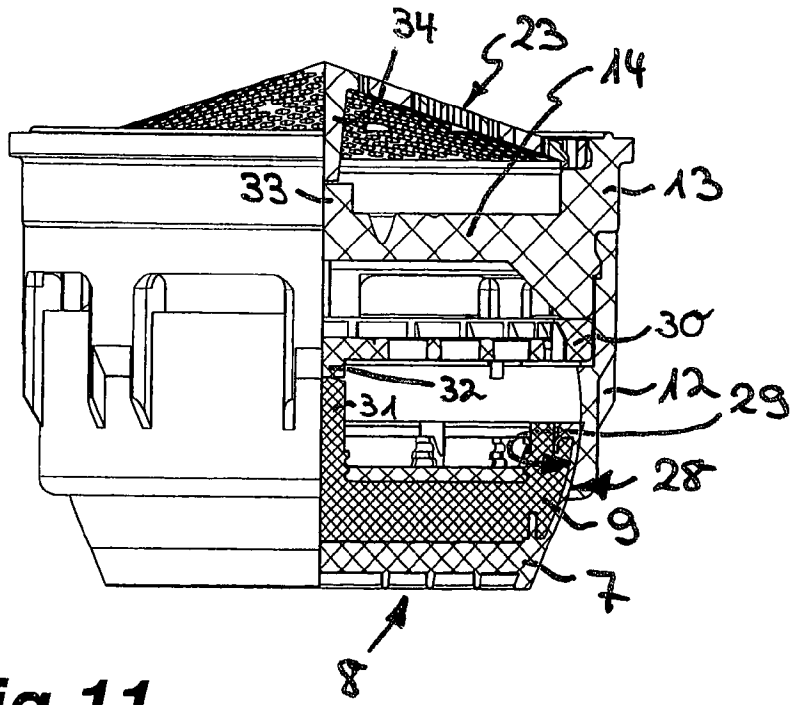
FIG. 11 shows the jet regulator from FIGS. 9 and 10 in a partial longitudinal section.
Figure 13:
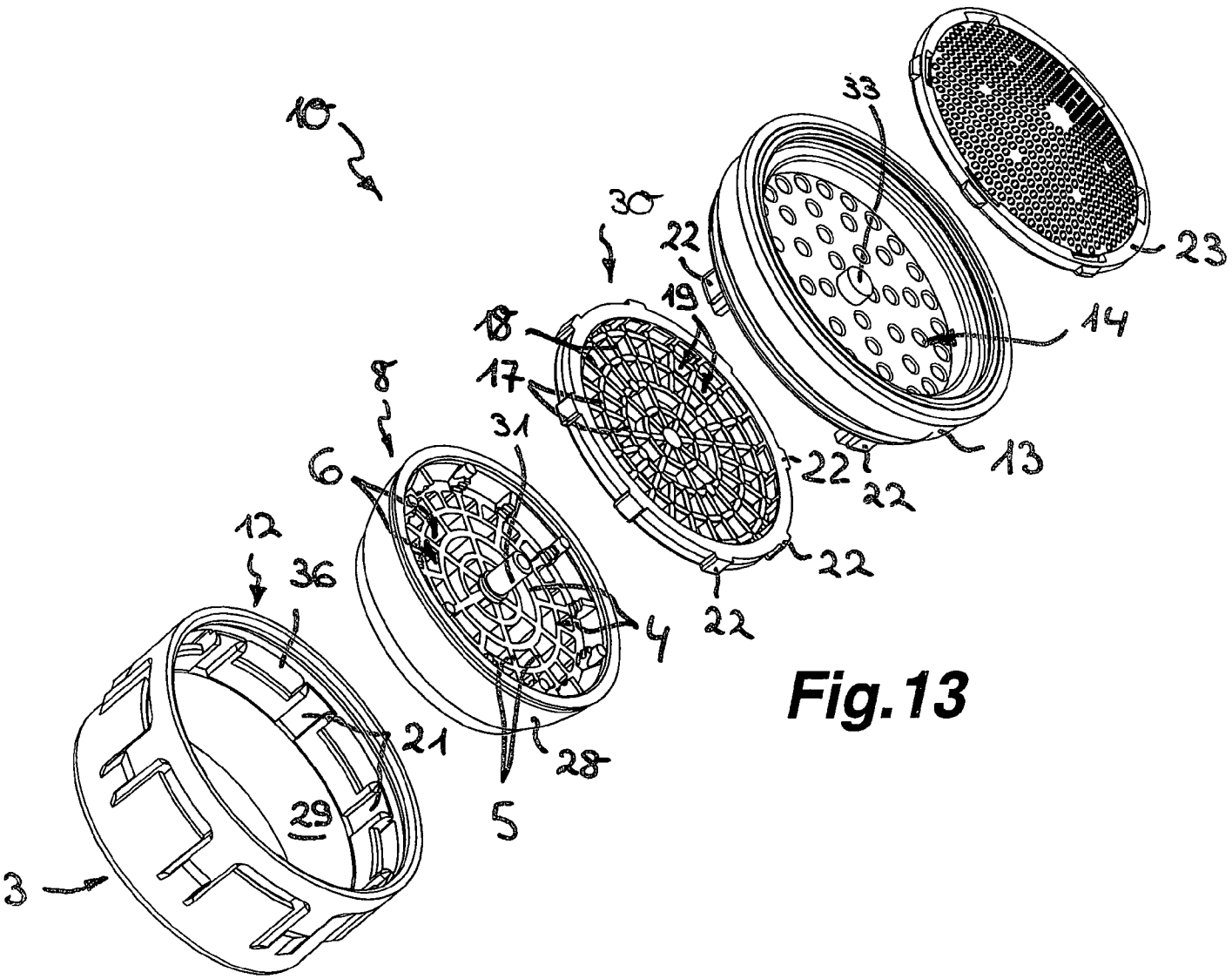
FIG. 13 shows the jet regulator from FIGS. 9 to 12 in an exploded perspective illustration, wherein said illustration shows a view of the inflow side of the constituents of the jet regulator.
Figure 14:
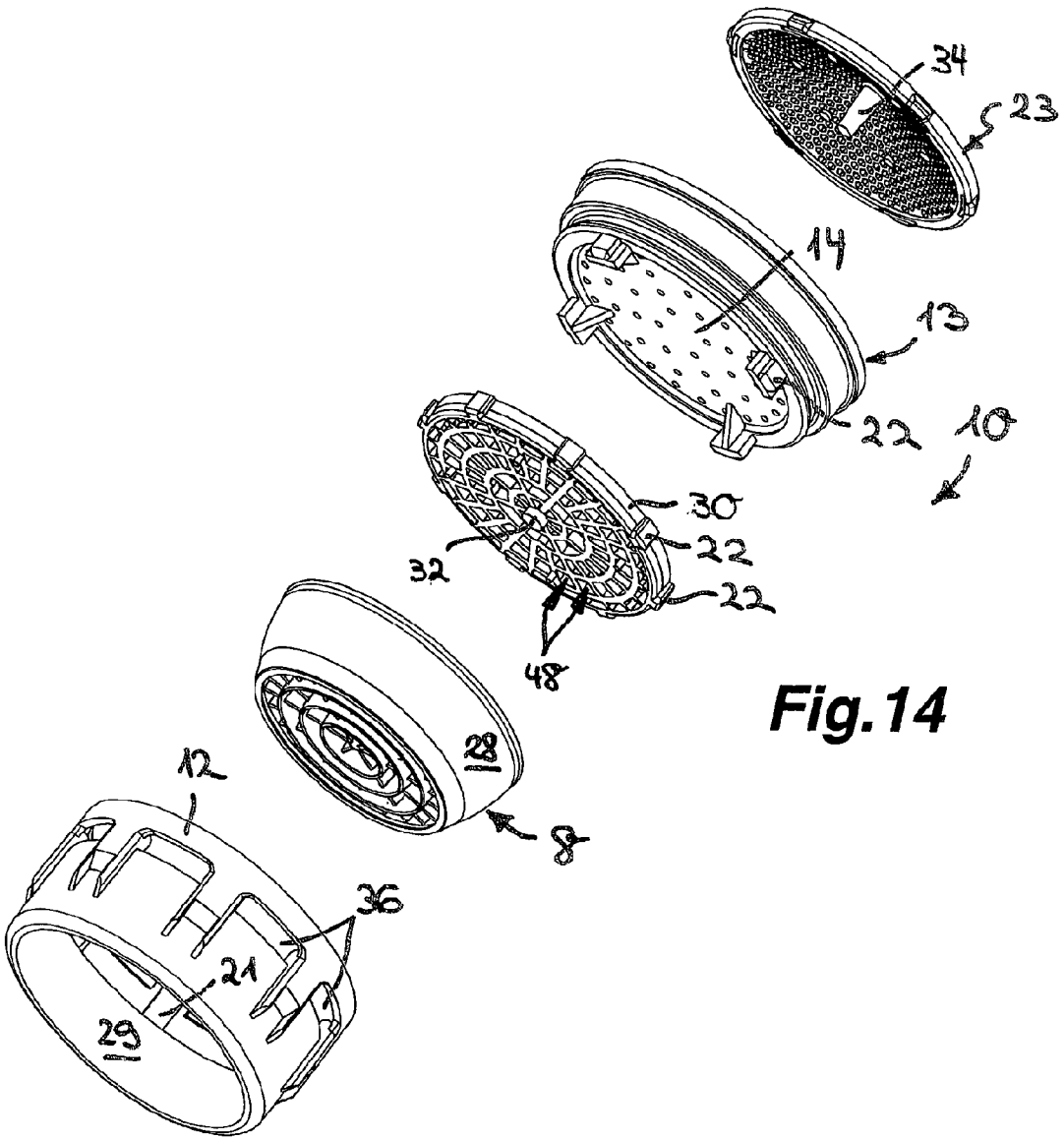
FIG. 14 shows the jet regulator from FIGS. 9 to 13 in an exploded perspective illustration, wherein the illustration shows a view of the outflow side of the constituents of the jet regulator.
Figure 16:
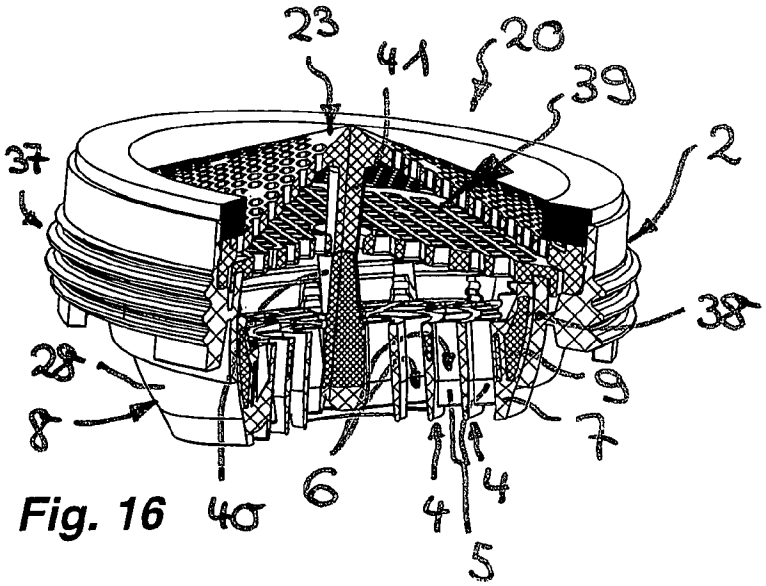
FIG. 16 shows the jet regulator from FIG. 15 in a partially sectional perspective illustration.
Figure 15:
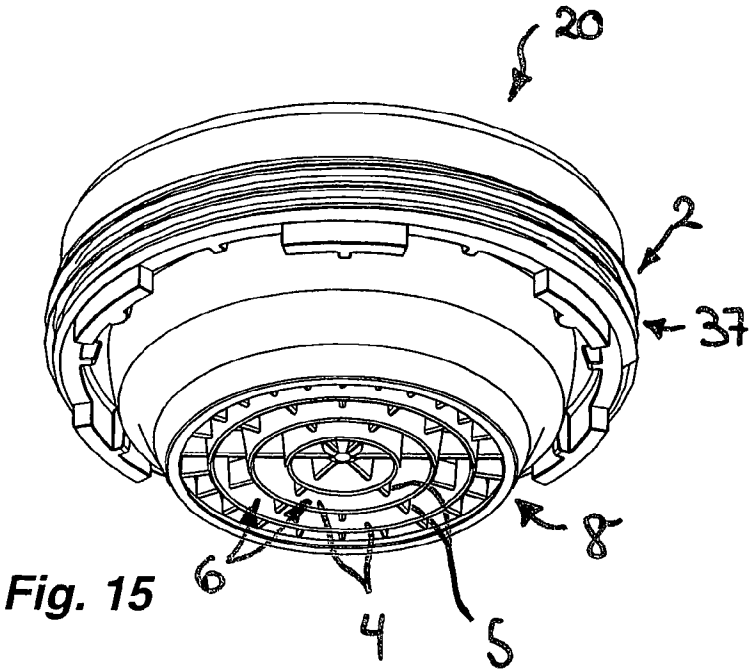
FIG. 15 shows, in a perspective illustration, a jet regulator which is of flat form and which can be mounted in the water outlet of an outlet fitting without the aid of an outlet mouthpiece.
Figure 18:
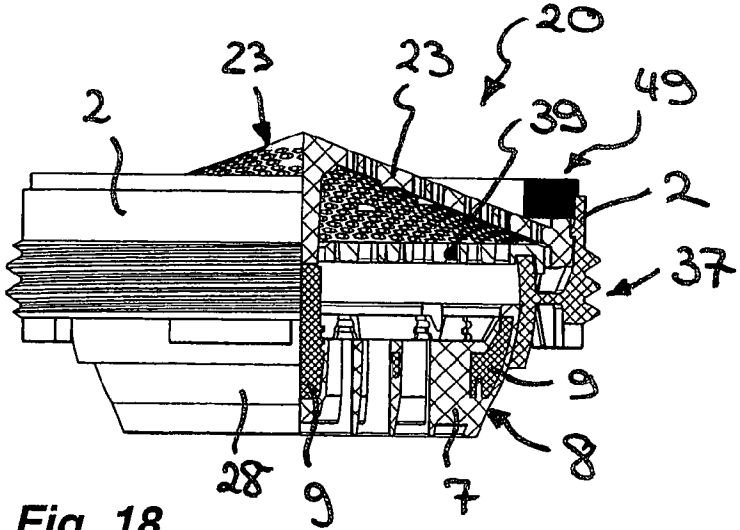
FIG. 18 shows the jet regulator from FIGS. 15 to 17 in a partial longitudinal section rotated in the circumferential direction.
Figure 17:
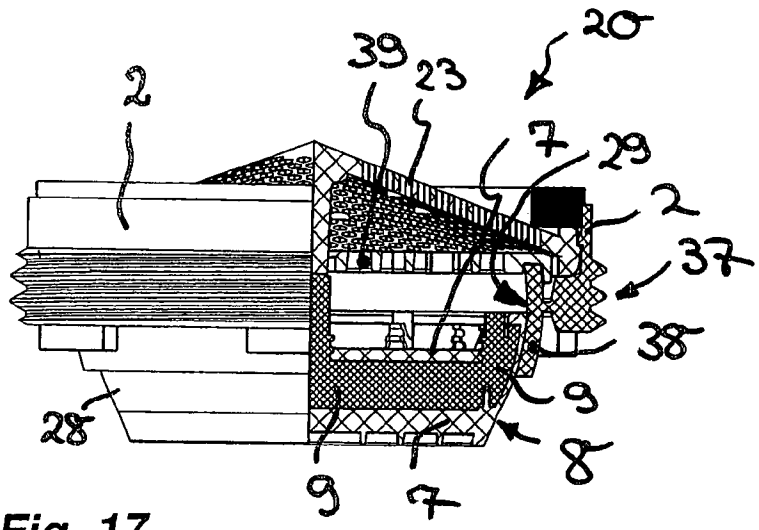
FIG. 17 shows the jet regulator from FIGS. 15 and 16 in a partial longitudinal section.
Figure 19:
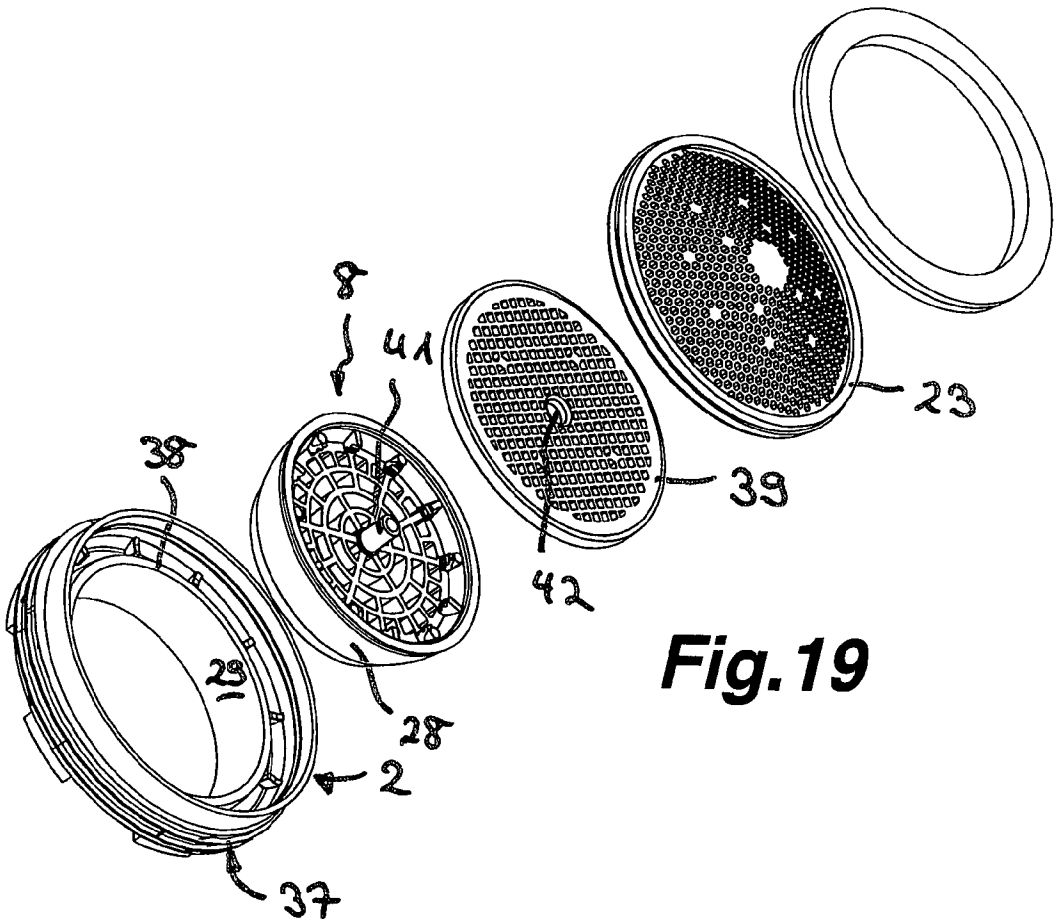
FIG. 19 shows the jet regulator from FIGS. 15 to 18 in an exploded perspective illustration, wherein the illustration shows a view of the inflow side of the constituents of the jet regulator.
Figure 20:
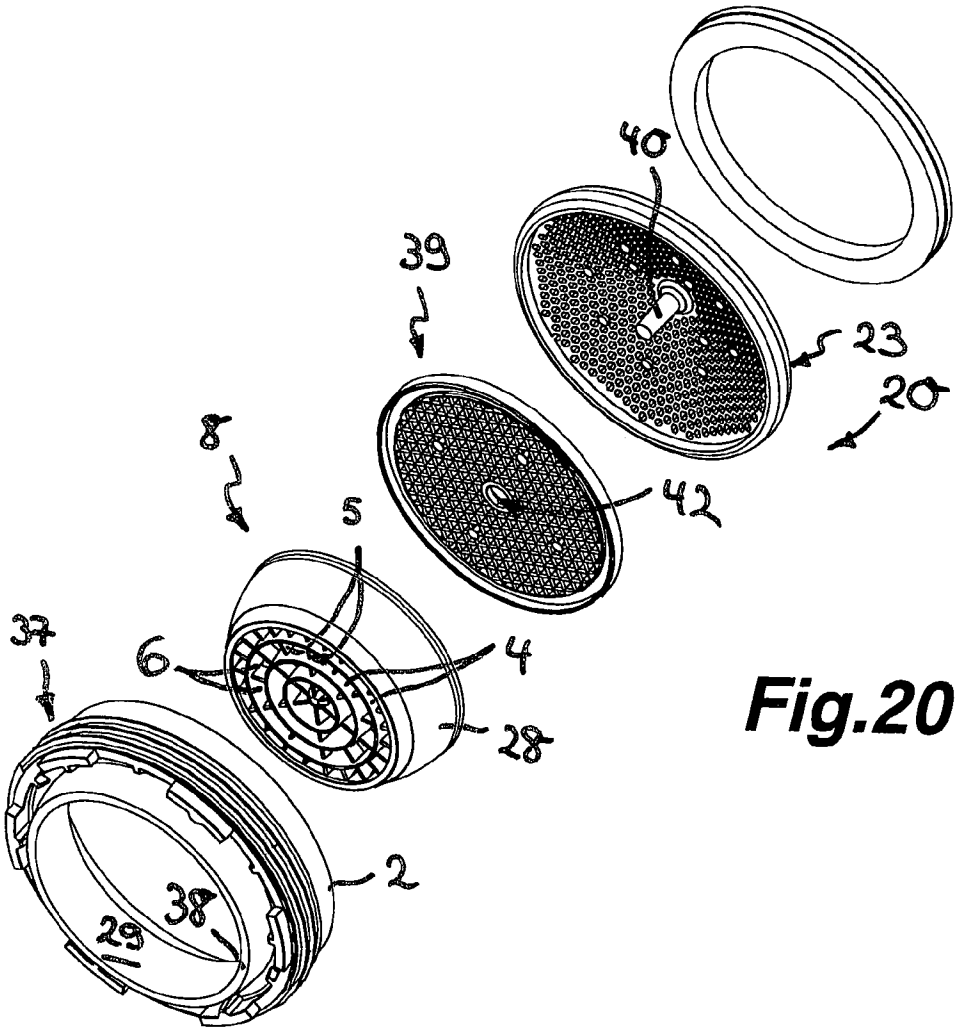
FIG. 20 shows the jet regulator from FIGS. 15 to 19 in an exploded perspective illustration, wherein the illustration shows a view of the outflow side of the constituents of the jet regulator.

FIGS. 1 to 20 show various embodiments 1, 10, 20 of a jet regulator which can be mounted on the water outlet on a sanitary outlet fitting (not shown in any more detail here). The jet regulators 1, 10, 20 have a ring-shaped or sleeve-shaped housing 2, the outlet face side 3 of which is formed as a mesh structure. This mesh structure is formed by concentric ring-shaped walls 4 which are connected to one another via radial webs 5. The ring-shaped walls 4 and the webs 5 form flow-guiding walls which border circular-arc-shaped throughflow openings 6. The outlet-face-side mesh structure of the jet regulator 1, 10, 20 is produced at least in regions and at least on the surface from a manually deformable, dimensionally elastic plastic material 7, and in particular from silicone, such that the limescale deposits which have adhered to the flow-guiding walls can be easily detached by slight manual deformation of the surface.

As is clear from a comparison of FIGS. 1 to 20, the outlet face side 3 of the jet regulators 1, 10, 20 is in the form of an outlet disk 8 which can be inserted into the jet regulator housing and which bears the mesh structure. The separate configuration of the outlet disk 8 on the one hand and of the jet regulator housing 2 on the other hand facilitates the separate production of said jet regulator constituents from different plastic materials, if appropriate in different production processes. The materials required for the outlet disk 8 on the one hand and for the jet regulator housing 2 on the other hand can be freely selected independently of one another in accordance with the relevant permissions, demands and the like. For the production of the jet regulator housing 2, therefore, it is possible for example to use an ultrasound-weldable material, which by contrast may not be preferable for the outlet disk 8.

In FIGS. 2 to 6, 10 to 12 and 16 to 18, it can be seen that the outlet disk 8 of the jet regulators 1, 10, 20 is in the form of a multi-component injection-molded part and has a main or molded body 9 which is comprised of hard or dimensionally rigid plastic material and onto which is injection-molded the constituent comprised of relatively soft or dimensionally elastic plastic material 7.

In the jet regulator 1 illustrated in FIGS. 1 to 8, the outlet disk 8 can be inserted into the jet regulator housing 2 from the inlet-side sleeve opening of the jet regulator housing 2 as far as an insertion stop 11. Here, the jet regulator housing 2 is of two-part configuration and has an upper and a lower housing part 12, 13. A jet splitter 14 which in this case is in the form of a perforated plate and which has the task of dividing the inflowing water stream into a number of individual jets is positioned upstream of the outlet disk 8 as viewed in the flow direction. Whereas the outlet disk 8 is inserted into the inlet-side sleeve opening of the lower outflow-side housing part 12, the jet splitter 14 which is in the form of a perforated disk is integrally formed on the upper, inflow-side housing part 13. At least one insert part 15, 16 can be inserted into the jet regulator housing 2 and in particular into the lower housing part 12 thereof such that said insert parts 15, 16 are positioned upstream of the outlet disk 8, and downstream of the jet splitter 14, as viewed in the flow direction. The insert parts 15, 16 likewise have concentric ring-shaped walls 17 which are connected to one another by radial webs 18, wherein here, too, said ring-shaped walls 17 and said webs 18 form flow-guiding walls which border circular-arc-shaped throughflow openings 19. The insert parts 15, 16 therefore also each have a mesh structure.

The outlet disk 8, the insert parts 15, 16 and the jet splitter 14 are held in a rotationally secured manner in the jet regulator housing 2 in such a way that their perforated or mesh structures are always arranged in the defined relative position with respect to one another. For this purpose, on the inner circumference of the jet regulator housing 2 and in particular of the lower housing part 12 thereof, there are provided a plurality of guide grooves 21 which interact in each case with a complementary guide projection 22 on the outlet disk 8, on the insert parts 15, 16 and on the jet splitter 14.

An upstream or filter screen 23, which has the task of filtering out any dirt particles entrained in the water, is detachably held on the jet regulator housing 2, and in particular on the upper housing part 13 thereof, at the inlet side. In the longitudinal sections in FIGS. 2, 3 and 5, it can be seen that central pins 24, 25, 26, 27 are integrally formed on the outlet disk 8 and the insert parts 15, 16 and on the jet splitter 14 and on the upstream screen 23, in such a way that said components 8, 15 and 16 and also 14 and 23 are supported against one another.

In the jet regulators 10, 20 in FIGS. 9 to 20, the outlet disk 8 which can be inserted into the jet regulator housing 2 is pivotably held in the jet regulator housing 2 in such a way that, by pivoting the outlet disk 8, the outlet direction of the water can be varied, and the emerging water jet re-directed. For this purpose, the outlet disk 8 of the jet regulator 10, 20 has, at least in regions, an outer circumference 28 which is in the shape of a spherical segment or spherical disk and by means of which the outlet disk 8 is pivotably held in a partial region, in the form of a joint socket 29, of the jet regulator housing 2.

It is clear from FIGS. 1 to 20 that the outlet disk 8, also in its partial region which bears against the jet regulator housing 2, bears the constituent comprised of relatively soft or dimensionally elastic plastic material 7. The soft or dimensionally elastic plastic material 7 which is provided in this region, too, promotes good sealing in the ring-shaped zone between the outlet disk 8 and the housing inner circumference of the jet regulator housing 2. This is particularly advantageous in particular also in the exemplary embodiments shown in FIGS. 11 to 20, because the outlet disk 8 which is pivotably mounted in the jet regulator housing 2 does not permit an infinitely high contact pressure of the outlet disk 8 in the jet regulator housing 2, but rather must be mounted there in a pivotable but nevertheless sealed manner.

A jet splitter 14 in the form of a perforated plate is also positioned upstream of the outlet disk 8 of the jet regulator 10 as viewed in the flow direction. Whereas the outlet disk 8 is held in the lower, outflow-side housing part 12 of the two-part jet regulator housing 2, the jet splitter 14 which is in the form of a perforated plate is integrally formed on the upper, inflow-side housing part 13. The housing parts 12, 13 of the jet regulator housing 2 can also be latched, or similarly detachably connected, to one another. Into the jet regulator housing 2 and in particular into the lower housing part 12 thereof there can be inserted an insert part 30 which has a mesh structure with circular-arc-shaped throughflow openings 48. The insert part 30 and the jet splitter 14 are held in a rotationally secured manner in the jet regulator housing 2. On the outlet disk 8 and on the insert part 30 and also on the jet splitter 14 and on an upstream or filter screen 23 positioned upstream there are provided central pins 31, 32 and 33, 34 respectively which support said components 8, 30 and 14, 23 respectively against one another.

The jet regulators 1, 10 have, on the outer circumference at their inlet-side face edge region, a ring-shaped flange 35, as far as which the jet regulators 1, 10 can be inserted into a sleeve-shaped outlet mouthpiece (not shown here) which can be mounted on the water outlet of the outlet fitting.

Whereas the jet regulators 1, 10 are designed as aerated jet regulators, in which ambient air can be sucked into the housing interior via aeration openings 36 in the jet regulator housing 2, which ambient air is subsequently mixed there with the water flowing through to form a sparkling, soft water jet, the jet regulator 20 illustrated in FIGS. 15 to 20 is in the form of a non-aerated jet regulator. The ring-shaped jet regulator housing 2 of the jet regulator 20 has, on its housing outer circumference, an external thread 37 by means of which the jet regulator 20 can be screwed without the aid of an outlet mouthpiece—if appropriate with the interposition of a sealing ring 49—directly into an internal thread provided on the water outlet of the sanitary outlet fitting. On the inner circumference of the ring-shaped jet regulator housing 2 there is provided a ring-shaped wall 38, the inner circumference of which is formed as a joint socket 29 for the outlet disk 8 pivotably held therein. The outlet disk 8 can be inserted into the jet regulator housing 2, into the in this case single-piece jet regulator housing 2 from the inflow face side. An insert part 39 is positioned upstream of the outlet disk 8 of the jet regulator 20 as viewed in the flow direction, which insert part has in this case a grate structure composed of two sets of parallel webs and webs which cross at intersection points. An upstream or filter screen 23 is positioned upstream of the outlet disk 8 and the grate-like insert part 39 and simultaneously forms the inlet face side of the jet regulator 20. On the outflow side of the upstream or filter screen 23 on the one hand and on the inlet side of the outflow disk 8 on the other hand there are provided central pins 40, 41 which extend through a central passage opening 42 in the insert part 39 in such a way that a controlled pivoting movement of the outlet disk 8 which is pivotably held in the jet regulator housing 2 of the jet regulator 2 is facilitated.

The invention claimed is:

1. A jet regulator (1, 10, 20) comprising a ring-shaped or sleeve-shaped jet regulator housing (2), an outlet face side (3) of which is formed as an outlet disk (8) which is inserted into the jet regulator housing (2) and which bears a perforated, grate or mesh structure with throughflow openings (6) bordered by flow-guiding walls, the perforated, grate or mesh structure on the outlet face side is produced at least in regions and at least on one surface thereof from a manually deformable dimensionally elastic plastic material (7), the outlet disk is inserted into the jet regulator housing (2) from an inlet-face-side ring or sleeve opening of the jet regulator housing (2) as far as at least one insertion stop (11), a jet splitter (14) which divides an inflowing water stream into a number of individual jets is positioned upstream of the outlet disk (8) as viewed in a flow direction, and at least one insert part (15, 16, 30, 19) which is inserted into the jet regulator housing (2) and has a perforated, grate or mesh structure with throughflow openings (19, 48, 43) bordered by flow-guiding walls is positioned upstream of the outlet disk (8), and/downstream of the jet splitter (14), as viewed in the flow direction, the outlet disk (8) is formed as a multi-component injection-molded part which has a main body (9) comprised of hard or dimensionally rigid plastic material onto which is injection-molded a constituent comprised of the dimensionally elastic plastic material (7) which is relatively softer than the dimensionally rigid plastic material, and the outlet disk (8) bears the constituent comprised of the relatively soft or dimensionally elastic plastic material (7) even in a partial region which bears against the jet regulator housing (2), so that the soft or dimensionally elastic plastic material (7) provides sealing in a ring-shaped zone between the outlet disk (8) and a housing inner circumference of the jet regulator housing (2).

2. The jet regulator as claimed in claim 1, wherein at least one of the outlet disk (8), the at least one insert part (15, 16, 30, 39) or the jet splitter (14) are held in a rotationally secured manner in the jet regulator housing (2).

3. The jet regulator as claimed in claim 2, wherein on the inner circumference of the jet regulator housing (2), there is provided at least one of a guide groove (21) or at least one guide projection which interacts with at least one of a complementary guide projection (22) or with a complementary guide groove on at least one of the outlet disk (8), the at least one insert part (15, 16, 30, 39) or the jet splitter (14).

4. The jet regulator as claimed in claim 1, wherein an upstream or filter screen (23) is detachably latched or detachably held, on the jet regulator housing (2) at an inlet side.

5. The jet regulator as claimed in claim 1, wherein at least one component of the following components: the outlet disk (8), the at least one insert part (15, 16, 30, 39), the jet splitter (14) or an upstream screen (23), is supported by at least one in pin (24, 25, 26, 27, 31, 32, 33, 34, 40, 41) on a component (8, 15, 16, 30, 39, 14, 23) which is arranged at at least one of an inflow side or an outflow side of the jet regulator.

6. The jet regulator as claimed in claim 1, wherein the outlet disk (8) is held pivotably in the jet regulator housing (2) for diverting or directing emerging water jet.

7. The jet regulator as claimed in claim 1, wherein the outlet disk (8) has, at least in regions, an outer circumference (28) which has a spherical segment or spherical disk shape and which is pivotably held in a partial region, in a joint socket (29), of the jet regulator housing (2).

8. The jet regulator as claimed in claim 1, wherein the outlet disk (8), in the partial region which bears against the jet regulator housing (2) has a spherical segment or spherical disk shape which bears the constituent comprised of the relatively soft or dimensionally elastic plastic material in order to seal off the ring-shaped zone between the outlet disk (8) and the housing inner circumference.

* * * * *